US008570316B2

(12) United States Patent
Ahn et al.

(10) Patent No.: US 8,570,316 B2
(45) Date of Patent: Oct. 29, 2013

(54) LIQUID CRYSTAL DISPLAY

(75) Inventors: Jiyoung Ahn, Anyang-si (KR); Dongwoo Kang, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 906 days.

(21) Appl. No.: 12/510,207

(22) Filed: Jul. 27, 2009

(65) Prior Publication Data

US 2010/0156884 A1 Jun. 24, 2010

(30) Foreign Application Priority Data

Dec. 24, 2008 (KR) ..... 10-2008-0133479

(51) Int. Cl.
*G09G 5/00* (2006.01)

(52) U.S. Cl.
USPC ..... 345/214

(58) Field of Classification Search
USPC ..... 345/87, 214
See application file for complete search history.

(56) References Cited

U.S. PATENT DOCUMENTS

| | | | | |
|---|---|---|---|---|
| 2001/0019382 | A1* | 9/2001 | Song et al. | 349/106 |
| 2005/0140614 | A1* | 6/2005 | Baek | 345/87 |
| 2005/0184998 | A1 | 8/2005 | Yang et al. | |
| 2009/0059078 | A1* | 3/2009 | Kim et al. | 348/645 |
| 2009/0086133 | A1* | 4/2009 | Chu Ke et al. | 349/106 |

FOREIGN PATENT DOCUMENTS

KR 10-2005-0083440 A 8/2005

* cited by examiner

*Primary Examiner* — Quan-Zhen Wang
*Assistant Examiner* — Tony Davis
(74) *Attorney, Agent, or Firm* — Birch, Stewart, Kolasch & Birch, LLP

(57) ABSTRACT

A liquid crystal display converts white luminance Y of data displaying a white background into a value satisfying a certain equation upon detecting a brightness contrast image including a pure color image with the white background.

8 Claims, 7 Drawing Sheets

LIQUID CRYSTAL DISPLAY

This application claims the benefit of Korean Patent Application No. 10-2008-0133479 filed on Dec. 24, 2008, the contents of which are entirely incorporated herein by reference for all purposes as if fully set forth herein.

BACKGROUND

1. Field

This document relates to a liquid crystal display and a method for driving the same.

2. Related Art

An active matrix driving type liquid crystal display device displays moving pictures by using a thin film transistor (hereinafter, "TFT") as a switching element. The liquid crystal display device is small-sized compared to a cathode ray tube (CRT), and hence is rapidly replacing the cathode ray tube (CRT) in televisions, as well as displays of mobile information devices, office machines, computers, etc.

In a liquid crystal display device, a pixel includes an R subpixel, a G subpixel, and a B subpixel for implementing colors. In recent years, a liquid crystal display having an RGBW pixel structure has been developed which has a white subpixel transmitting white light in addition to subpixels of the three primary colors of RGB, in order to increase the luminance of the liquid crystal display.

In the liquid crystal display having the RGBW structure, the brightness of the RGB subpixels is relatively low compared to a conventional RGB pixel structure due to the brightness of the white subpixel. Owing to this, the liquid crystal display having the RGBW pixel structure may suffer from brightness contrast on a white background, whereby the saturation of pure colors is reduced compared to the conventional RGB pixel structure.

SUMMARY

The present invention provides a liquid crystal display with an RGBW pixel structure that has improved pure color picture quality.

There is provided a liquid crystal display according to an exemplary embodiment of the present invention, including: an RGBW panel having a plurality of data lines, a plurality of gate lines crossing the data lines, a plurality of TFTs connected to crossings between the data lines and the gate lines, and an RGBW pixel structure; an image conversion unit for converting white luminance Y of data displaying a white background into a value satisfying any one of the following equations upon detecting a brightness contrast image including a pure color image with the white background; a data driving circuit for converting digital data converted by the image conversion unit into positive/negative analog data voltages; and a gate driving circuit for supplying gate pulses to the gate lines, the equations including $$Y(\text{white}) = Yref(\text{white}) \times \text{MIN}\left\{\frac{Y(\text{yellow})}{Yref(\text{yellow})}, \frac{Y(\text{cyan})}{Yref(\text{cyan})}, \frac{Y(\text{magenta})}{Yref(\text{magenta})}\right\},$$

$$Y(\text{white}) = Yref(\text{white}) \times \frac{Y(\text{yellow})}{Yref(\text{yellow})}, \text{ and}$$

$$Y(\text{white}) = Y(\text{yellow})$$

wherein Y(X) is a luminance value of color X, Yref(X) is a luminance value of color X of a reference display device having an RGB pixel structure, and MIN Y(X, Y, Z) is the minimum luminance value among X, Y, and Z.

There is provided a liquid crystal display according to another exemplary embodiment of the present invention, including: an RGBW panel having a plurality of data lines, a plurality of gate lines crossing the data lines, a plurality of TFTs connected to crossings between the data lines and the gate lines, and an RGBW pixel structure; an image conversion unit for converting one or more of R subpixel data, G subpixel data, B subpixel data, and W subpixel data displaying a pure color image into a value higher than an input value upon detecting a brightness contrast image including a pure color image with a white background; a data driving circuit for converting digital data converted by the image conversion unit into positive/negative analog data voltages; and a gate driving circuit for supplying gate pulses to the gate lines.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Hereinafter, an implementation of this document will be described in detail with reference to FIGS. 1 to 8.

Figure 1:
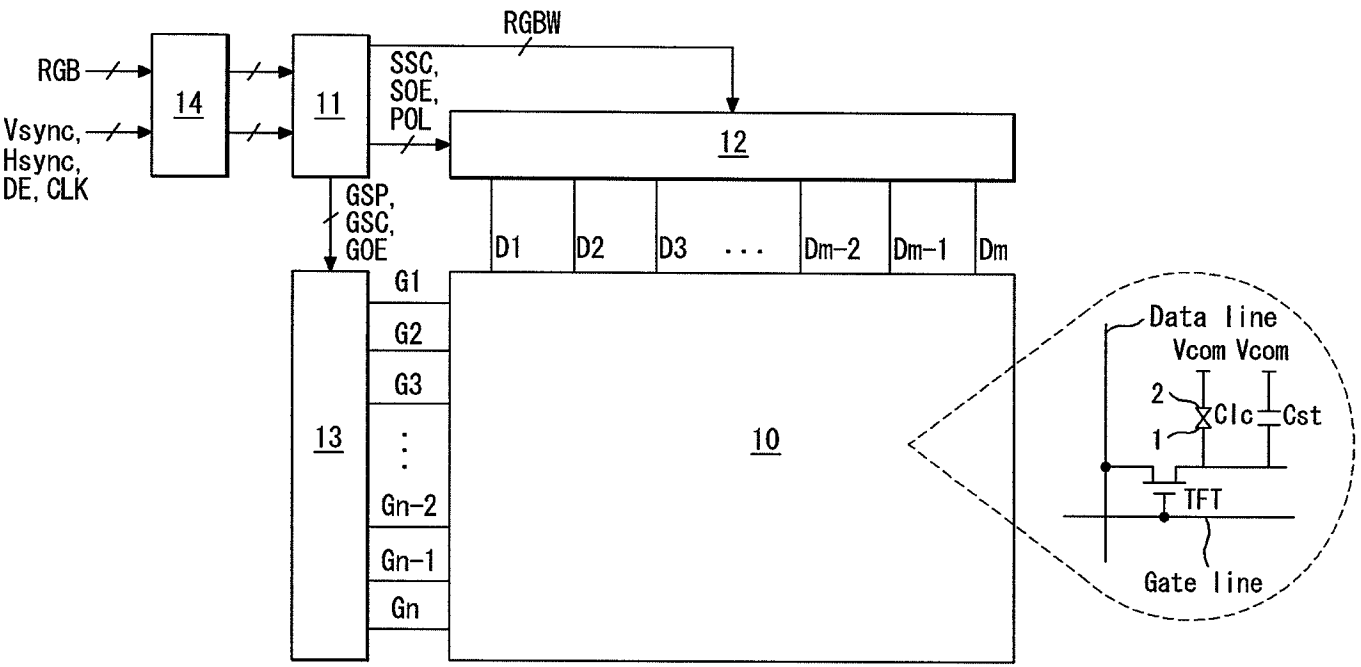
FIG. 1 is a block diagram showing a liquid crystal display according to an exemplary embodiment of the present invention.
Figure 2:
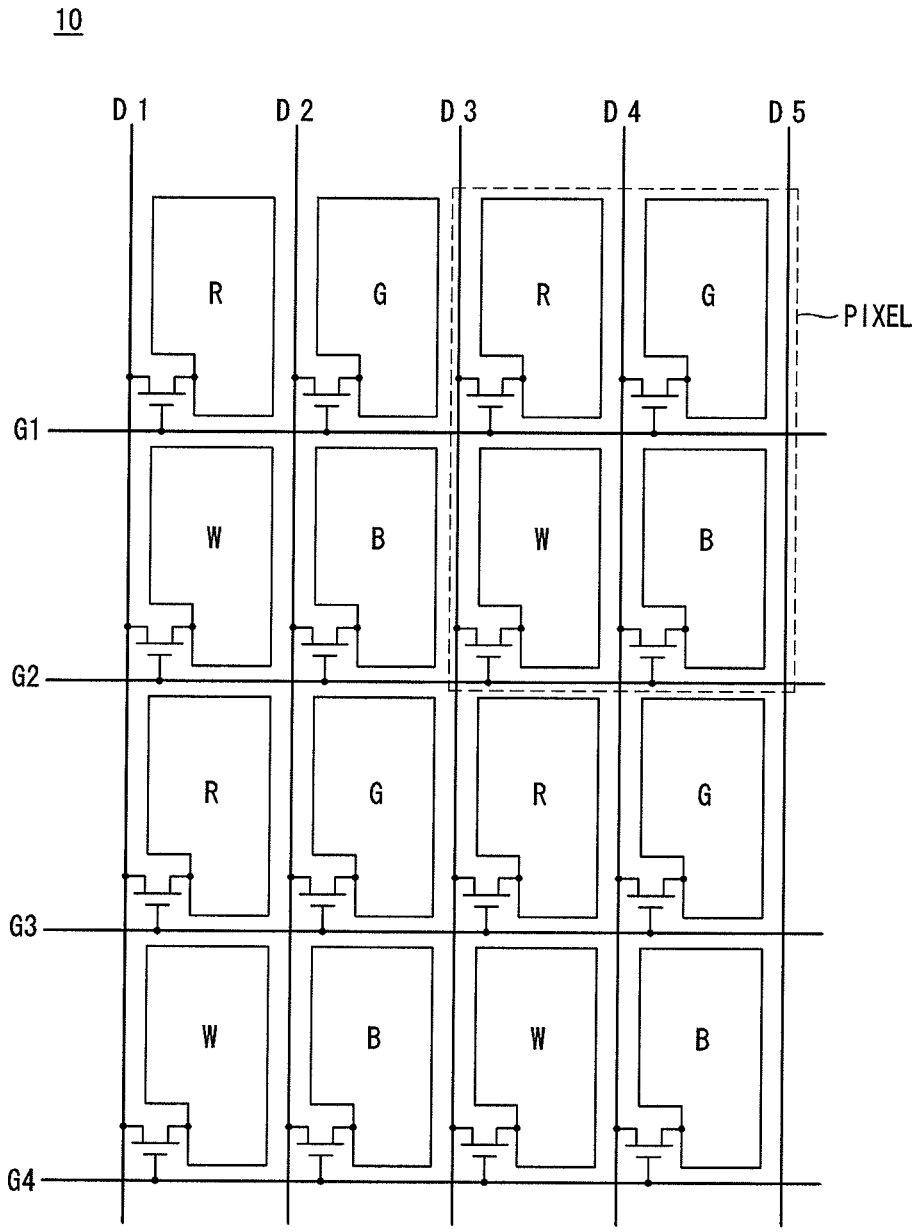
FIG. 2 is an equivalent circuit diagram showing part of a pixel array in a liquid crystal display panel shown in FIG. 1.

Referring to FIGS. 1 and 2, a liquid crystal display according to an exemplary embodiment of the present invention includes an RGBW panel 10, an image conversion unit 14, a timing controller 11, a data driving circuit 12, and a gate driving circuit 13. The data driving circuit 12 includes a plurality of source drive ICs. The gate driving circuit 13 includes a plurality of gate drive ICs.

The RGBW panel 10 has a liquid crystal layer formed between two glass substrates. The RGBW panel 10 includes liquid crystal cells Clc arranged in a matrix on an intersection structure of data lines D1~Dm and gate lines G1~Gn.

On the lower glass substrate of the RGBW panel 10, there are formed data lines D1~Dm, gate lines G~Gn, TFTs, storage capacitors Cst, and so forth. The liquid crystal cells Clc are connected to the TFTs and driven by electric fields between pixel electrodes 1 and common electrodes 2. On the upper glass substrate of the RGBW panel 10, there are formed a black matrix, color filters, and common electrodes 2.

The common electrodes 2 are formed on the upper glass substrate to implement a vertical electric field driving method such as a twisted nematic (TN) mode or a vertical alignment (VA) mode. Alternatively, the common electrodes 2 are formed together with the pixel electrode 1 on the lower glass substrate to implement a horizontal electric field driving method such as an in-plane switching (IPS) mode or a fringe field switching (FFS) mode.

Polarizers are placed on the upper glass substrate and the lower glass substrate of the RGBW panel 10, and alignment films for setting a pre-tilt angle of liquid crystals are formed on the upper glass substrate and lower glass substrate of the RGBW panel 10.

In this RGBW panel 10, each pixel includes an R subpixel, a G subpixel, a B subpixel, and a W subpixel. On the upper glass substrate, an R color filter is formed in the R subpixel, a G color filter is formed in the G subpixel, and a B color filter is formed in the B subpixel. On the upper glass substrate, no color filter is formed in the W subpixel. An R data voltage and a W data voltage are supplied to the odd-numbered data lines D1, D3, . . . , Dm-1, and a G data voltage and a B data voltage are supplied to the even-numbered data lines D2, D4, . . . , Dm. The liquid crystal cells Clc of the odd-numbered lines are charged with the R data voltage and the G data voltage through the TFTs which are turned on in response to the gate pulses supplied to the odd-numbered gate lines G1, G3, . . . , Gn-1. The liquid crystal cells Clc of the odd-numbered lines are charged with the W data voltage and the B data voltage through the TFTs which are turned on in response to the gate pulses supplied to the even-numbered gate lines G2, G4, . . . , Gn. The pixel structure of the present invention is not limited to the structure shown in FIG. 2, but may be implemented in various forms including RGBW subpixels.

The liquid crystal mode of the RGBW panel 10 applicable in the present invention may be implemented as any liquid crystal mode, as well as the above-stated TN mode, VA mode, IPS mode, and FFS mode. Moreover, the liquid crystal display of the present invention may be implemented in any form, including a transmissive liquid crystal display, a semi-transmissive liquid crystal display, and a reflective liquid crystal display. The transmissive liquid crystal display and the semi-transmissive liquid crystal display require a backlight unit which is omitted in the drawings.

The image conversion unit 14 detects input data of an image having brightness contrast. The image conversion unit 14 adjusts the white luminance of a white background or the brightness of pure colors in order to obtain a sense of color from the RGBW panel 10 that is better than the sense of pure colors visually obtained from a reference display device having an RGB pixel structure, upon detecting brightness contrast. The reference display device is a liquid crystal display panel having an RGB pixel structure with no white subpixel.

The timing controller 11 supplies digital video data including white data and RGB data generated by the image conversion unit 14 to the data driving circuit 12. The timing controller 11 can transmit digital video data and a mini LVDS clock to the data driving circuit 12 by a mini LVDS (low-voltage differential signaling) method.

The timing controller 11 controls the operation timing of the data driving circuit 12 and the gate driving circuit 13 by using timing signals, such as a vertical synchronization signal Vsync, a horizontal synchronization signal Hsync, a data enable signal DE, and a dot clock (CLK) signal. Since the timing controller 11 can determine a frame period by counting data enable signals of 1 horizontal period, the vertical synchronization signal Vsync and the horizontal synchronization signal Hsync can be omitted among the timing signals input to the timing controller 11. Control signals of the driving circuits 12 and 13 generated from the timing controller 11 include a gate timing control signal for controlling the operation timing of the gate driving circuit 13 and a data timing control signal for controlling the operation timing of the data driving circuit 12 and the polarity of data voltages.

The gate timing control signals include a gate start pulse GSP, a gate shift clock signal GSC, a gate output enable signal GOE, etc. The gate start pulse GSP is applied to the gate drive ICs for generating a first gate pulse (or scan pulse). The gate shift clock signal GSC is commonly input to the gate drive ICs, to shift the gate start pulse GSP. The gate output enable signal GOE controls an output from the gate drive ICs.

The data timing control signals include a source start pulse SSP, a source sampling clock SSC, a polarity control signal POL, a source output enable signal SOE, etc. The source start pulse SSP controls a data sampling start point of the data driving circuit 12. The source sampling clock SSC is a clock signal which controls a data sampling operation in the data driving circuit 12 based on a rising or falling edge. The polarity control signal POL controls the vertical polarity of a data voltage output from the data driving circuit 12. The source output enable signal SOE controls an output from the data driving circuit 12. If digital video data and a mini LVDS clock are transmitted between the timing controller 11 and the data driving circuit 12 in accordance with a mini LVDS scheme, a first clock generated after a reset signal of the mini LVDS clock serves as a start pulse. Thus, the source start pulse SSP may be omitted.

The gate driving circuit 12 includes a shift register, a latch, a digital-to-analog converter, and an output buffer. The data driving circuit 12 latches digital video data RGBW under the control of the timing controller 11. The data driving circuit 12 also converts the latched digital video data RGBW into positive/negative analog gamma compensating voltages in accordance with the polarity control signal POL, and thus generates positive/negative analog data voltages. The data voltages are supplied to the data lines D1~Dm.

The gate driving circuit 13 includes a shift register, an AND gate, a level shifter, and an output buffer. The gate driving circuit 13 sequentially supplies gate pulses to the gate lines G1~Gn in response to the gate timing control signals GSP, GSS, and GOE.

Figure 3:
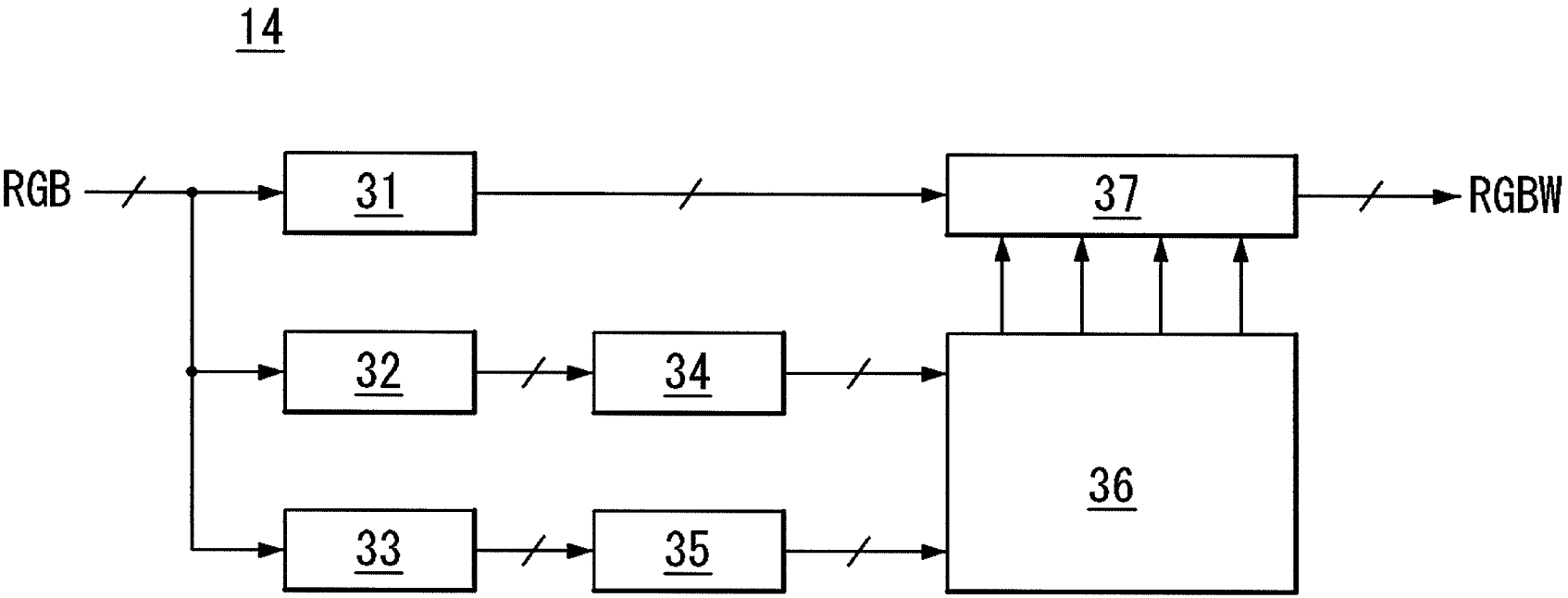
FIG. 3 is a block diagram showing in detail an image conversion unit shown in FIG. 1.

FIG. 3 shows a circuit configuration of the image conversion unit 14.

Referring to FIG. 3, the image conversion unit 14 includes a frame buffer 31, a chromatic analysis part 32, an achromatic analysis part 33, a chromatic histogram analysis part 34, an achromatic histogram analysis part 35, a white/pure color correction part 36, and a data conversion part 37.

The frame buffer 31 temporarily stores input RGB digital video data and then supplies it to the data conversion part 37 to be synchronized with an output from the white/pure color correction part 36. The chromatic analysis part 32 calculates the luminance of pure colors of yellow, cyan, and magenta for each of the pixels from the input RGB digital video data. When pixel values of the input RGB digital video data are R=170~255, G=170~255, and B=0~10, the chromatic analysis part 32 determines that the pixel data is yellow data, and when pixel values of the input RGB digital video data are R=0~10, G=170~255, and B=170~255, the chromatic analysis part 32 determines that the pixel data is cyan data. Also, when pixel values of the input RGB digital video data are R=170~255, G=0~10, and B=170~255, the chromatic analysis part 32 determines that the pixel data is magenta data. The chromatic analysis part 32 can calculate the luminance of pure colors of yellow, cyan, and magenta by the following Equation (1):

$$Y=0.299R+0.589G+0.114B \quad (1)$$

The achromatic analysis part 33 calculates the luminance of an achromatic color, i.e., white, of each of the pixels from the input RGB digital video data. When pixel values of the input RGB digital video data are R=170~255, G=170~255, and B=170~255, the achromatic analysis part 33 can determine that the pixel data is white data, and can calculate the luminance of the white data by Equation 1.

The chromatic histogram analysis part 34 receives luminance values of pure colors for each pixel of one frame image from the chromatic analysis part 32 and analyzes the distribution of pure color gray scales of one frame image by using a histogram analysis technique. The achromatic histogram analysis part 35 receives luminance values of achromatic colors for each pixel of one frame image from the achromatic analysis part 35 and analyzes the distribution of achromatic gray scales for each pixel of one frame image from the achromatic analysis part 33.

Figure 6:
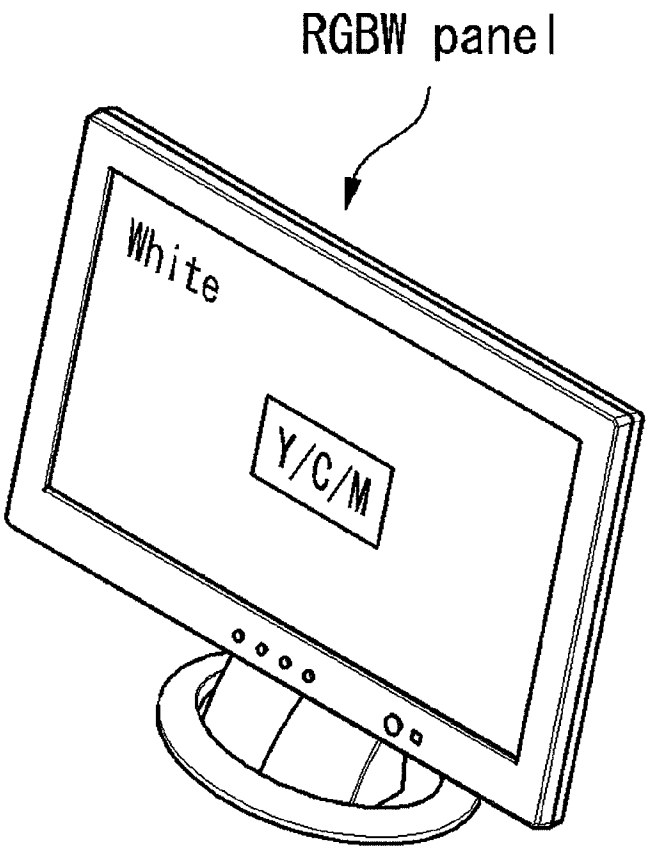
FIG. 6 is a view showing an RGB panel and an experimentation environment in which a brightness contrast image is displayed on the RGB panel.
Figure 6:
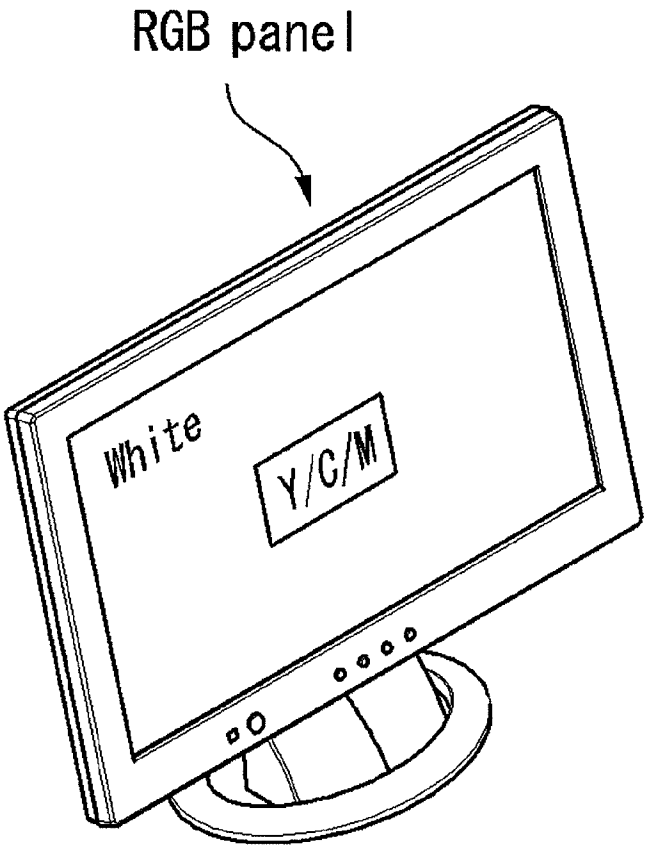

The white/pure color correction part 36 analyzes pure color histogram information from the chromatic histogram analysis part 34 and achromatic histogram information from the achromatic histogram analysis part 35 to detect an image showing brightness contrast or a pure color. The image showing brightness contrast is an image in which pure colors of yellow, cyan, and magenta are displayed on the white background as shown in FIG. 6, which is visually deteriorated in picture quality of pure colors due to a white luminance. Upon detecting an image having brightness contrast, the white/pure color correction part 36 determines the white luminance {Y(white)} of the white background by a method described in the following Exemplary Embodiments 1 to 3.

The white/pure correction part 36 can increase the brightness of pure colors by correcting the luminance {Y(yellow, cyan, magenta)} of pure colors of an image having brightness contrast by a method described in the following Exemplary Embodiment 4 as another exemplary embodiment. While the white/pure color correction part 36 equalizes the white luminance of the white background for determining the brightness of a white subpixel of an image having brightness contrast regardless of a gray scale change in accordance with Exemplary Embodiment 5, in still another exemplary embodiment, the white/pure color correction part 36 can increase the white luminance of the white background of an image having no brightness contrast in proportion to a gray scale value. The white/pure color correction part 36 can be implemented as an arithmetic circuit or a lookup table.

The data conversion part 37 corrects white data of R+G+B+W pixels in the white background of an image having brightness contrast with the RGB digital video data input through the frame buffer 31 and the white luminance input from the white/pure color correction part 36. Also, the data conversion part 37 can correct pure color data to be supplied to the RGB subpixels of a pure color pixel of an image having brightness contrast based on a pure color luminance input from the white/pure color correction part 36.

First Exemplary Embodiment

In the first exemplary embodiment of the present invention, a white luminance of the white background of an image having brightness contrast is determined based on the following proportional expression.

MIN Yref(yellow, magenta, cyan):Yref(white) of a reference display device=MIN Y(yellow, magenta, cyan):Y(white) of RGBW panel 10. In other words, the ratio of pure color luminance {Y(yellow, magenta, cyan)} to white luminance {Y(white)} of the RGBW panel 10 is determined by the ratio of pure color luminance {Yref(yellow, magenta, cyan)} to white luminance {Yref(white)} of the reference display device.

Figure 4:
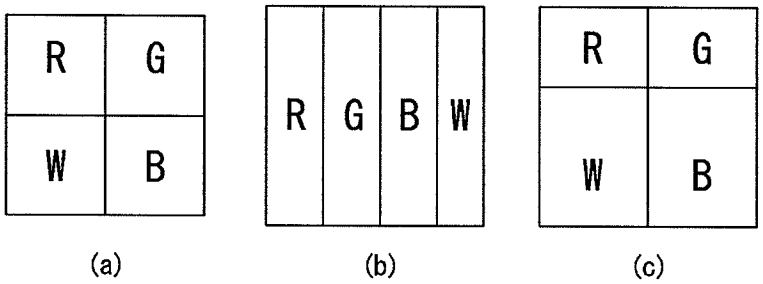
FIG. 4 is a view showing an area of RGBW subpixels in an RGBW pixel structure.
Figure 5:
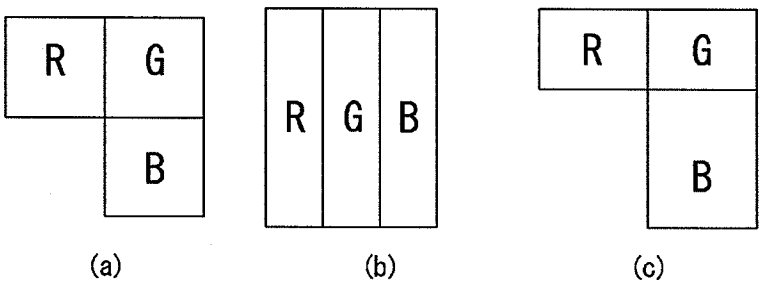
FIG. 5 is a view showing an area of RGB subpixels in the RGBW pixel structure.

The pure color luminance and white luminance of the reference display device may be derived from the relative luminance relationship of the reference display device specified in ITU-BT.709, or may be determined from R, G, B, W (white) information of the RGBW panel 10. The latter method will now be described. A pixel structure of the RGBW panel 10 may be implemented in various structures including an R subpixel, a G subpixel, a B subpixel, and a W subpixel, as shown in FIG. 4. If the area of RGBW subpixels of a unit pixel is denoted by 'ARGBW' as shown in FIG. 4, and the area of the RGB subpixels, excluding the W subpixel, of the unit pixel is denoted by 'ARGB' as shown in FIG. 5, the ratio ra of the area of the RGBW subpixels to the area of the RGB subpixels of the unit pixel can be expressed by ra=ARGBW/ARGB. If the white luminance of the RGB subpixels of the unit pixel is denoted by Y(whiteRGB) and the pure color luminances thereof are denoted by Y(yellowRG), Y(cyanGB), and Y(magentaRB), the white luminance Yref(WhiteRGB) of the reference display device is Yref(WhiteRGB)=Y(WhiteRGB)×ra and the respective pure color luminances Yref(yellowRG), Yref(cyanGB), and Yref(magentaRB) of the reference display device are Yref(yellowRG)=Y(yellowRG)×ra, Yref(cyanGB)=Y(cyanGB)×ra, and Yref(magentaRB)=Y(magentaRB)×ra.

The white luminance {Y(white)} of the RGBW panel 10 can be calculated by the following Equation (2):

$$Y(\text{white}) = Yref(\text{white}) \times \text{MIN}\left\{\frac{Y(\text{yellow})}{Yref(\text{yellow})}, \frac{Y(\text{cyan})}{Yref(\text{cyan})}, \frac{Y(\text{magenta})}{Yref(\text{magenta})}\right\} \quad (2)$$

wherein MIN {Y(yellow), Y(cyan), Y(magenta)} is the minimum luminance among yellow, cyan, and magenta.

When a brightness contrast image is displayed on the reference display device, the white/pure color correction part 36 determines the white luminance of the white background by multiplying the white luminance of the white background by the luminance having the smallest value in the pure color luminance ratio of the reference display device and the RGBW panel 10 in accordance with Equation (2). For example, if the yellow luminance of the reference display device is '90', the luminance of the white background of the reference display device is '100', and the yellow luminance of the RGBW panel 10 is '70', the white/pure color correction part 36 calculates the white luminance of the white background of the brightness contrast image input to the RGBW panel 10 as being Y(white)=70×(100/90)=78.

Second Exemplary Embodiment

When a pure color image with a white background is detected from an image having brightness contrast as shown in FIG. 4, the white/pure color correction part 36 can calculate the luminance of the white background by the following Equation (3):

$$Y(\text{white}) = Yref(\text{white}) \times \frac{Y(\text{yellow})}{Yref(\text{yellow})} \quad (3)$$

When a brightness contrast image is displayed on the reference display device, the white/pure color correction part 36 determines the white luminance of the white background of the image having brightness contrast by multiplying the white luminance of the white background by the yellow luminance ratio of the reference display device and the RGBW panel 10 as in Equation (3).

Third Exemplary Embodiment

The white/pure color correction part 36 can determine the white luminance of the white background of an image having brightness contrast to be the same value as the yellow luminance, i.e., Y(white)=Y(yellow).

Fourth Exemplary Embodiment

When an image having brightness contrast is detected as shown in FIG. 6, the white/pure color correction part 36 adjusts the luminance of one or more of RGBW data to be higher than an input luminance value in order to increase the brightness of pure colors. Although the saturation of pure colors may be equal to or lower than that of the reference display device, the sense of pure colors of the RGBW panel 10 that an observer subjectively perceives can be increased by increasing the brightness of the pure colors. Also, when a pure color image with a white background having brightness contrast is input, as shown in FIG. 6, the white/pure color correction part 36 can calculate the white luminance by the method described above in Exemplary Embodiments 1 to 3.

Figure 7:
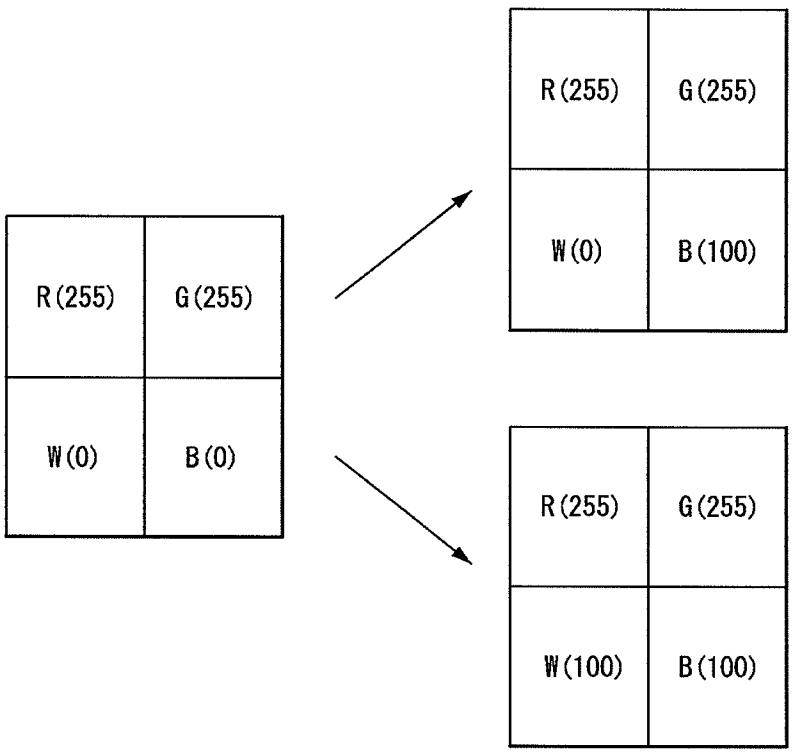
FIG. 7 is a view schematically showing an exemplary embodiment for improving the brightness of pure colors.

For example, when a yellow image with the white background having brightness contrast is input to the RGBW panel 10, if the luminance of yellow is R=255, G=255, B=0, and W=0 as shown in FIG. 7, the white/pure color correction part 36 calculates a white luminance for increasing the luminance of a white subpixel, and a yellow luminance weight for increasing the luminance of a blue subpixel, in order to increase the brightness of yellow. The yellow luminance weight value is added to any one or more of RGB digital video data by the data conversion part 37. However, as shown in FIG. 7, if R and G digital video data values are peak values, the yellow luminance weight value is added only to B digital video data. A cyan weight value is added to one or more of RGB digital video data of the pixel values of cyan when a cyan image with the white background having brightness contrast is input, and a magenta weight value is added to one or more of RGB digital video data of the pixel values of magenta.

In order to increase the brightness of pure colors according to another exemplary embodiment, the white/pure color correction part 36 may increase the pure color luminance by increasing the white data value of pure color pixel data in the example of R=170~255, G=170~255, B=0, and W=0 as shown in the example of R=170~255, G=170~255, B=0, and W=10, or may increase the pure color luminance by increasing pure color data and white data by a method as shown in the example of R=170~255, G=170~255, B=20, and W=10.

Fifth Exemplary Embodiment

Figure 8:
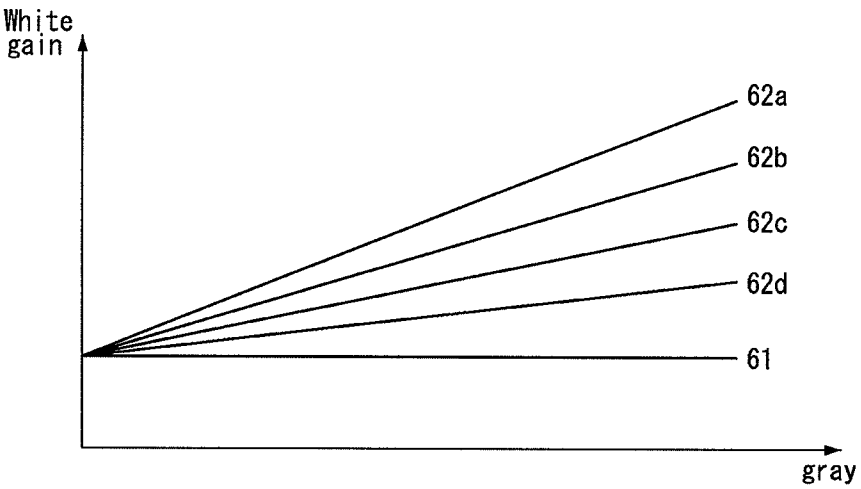
FIG. 8 is a view showing a white gain of a brightness contrast image and a white gain of an image having no brightness contrast.

Referring to FIG. 8, when an image having brightness contrast is detected as shown in FIG. 6, the white/pure color correction part 36 fixes the luminance of the white background to a constant value 61 regardless of a gray scale of input data. On the other hand, when an image having no brightness contrast is input, the white/pure color correction part 36 increases the luminance 61*a*~61*d* of white data to be supplied to a white subpixel in accordance with a gray scale of input data.

One or more of the above-described exemplary embodiments can be applied to the liquid crystal display of the present invention.

In order to verify the effect of the present invention on pure color picture quality, an experiment was performed in which an image having brightness contrast as shown in FIG. 6 was displayed equally on a reference display device and the RGBW panel 10, and ten subjects positioned in front of the two panels were asked to gauge their subjective sense of the color quality in both dark and bright environments. In this experiment, when the brightness of white data or pure color data to be supplied to the RGBW panel 10 was corrected by the method of Exemplary Embodiments 1 to 5, the subjects perceived the pure color quality of the RGBW panel 10 as being equal to or better than the color quality of the reference display device.

As described in detail above, the liquid crystal display according to exemplary embodiments of the present invention can improve pure color picture quality in a liquid crystal display having an RGBW pixel structure by decreasing the brightness of a white background or increasing the brightness of pure colors under preset conditions in a brightness contrast image including a pure color image with the white background.

Although exemplary embodiments have been described, it should be understood that numerous other modifications and embodiments can be devised by those skilled in the art that will fall within the spirit and scope of the principles of this disclosure. More particularly, various modifications can be made to components and/or arrangements of the subject combination arrangement within the scope of the disclosure, the drawings and the appended claims. In addition to variations and modifications to the components and/or arrangements, alternative uses will also be apparent to those skilled in the art.

What is claimed is:

1. A liquid crystal display, comprising:

an RGBW panel having a plurality of data lines, a plurality of gate lines crossing the data lines, a plurality of TFTs connected to crossings between the data lines and the gate lines, and an RGBW pixel structure;

an image conversion unit for converting white luminance Y of data displaying a white background into a value satisfying any one of the following equations upon detecting a brightness contrast image including a pure color image corresponding to any one of a yellow, a cyan, and a magenta image with the white background;

a data driving circuit for converting digital data converted by the image conversion unit into positive/negative analog data voltages; and a gate driving circuit for supplying gate pulses to the gate lines, wherein the image conversion unit includes a chromatic analysis part for calculating the luminance of yellow data, cyan data, or magenta data after analyzing pixel data of input RGB digital video data, and determining the pixel data as the yellow data, the cyan data, or the magenta data, the equations including:

$$Y(\text{white}) = Yref(\text{white}) \times \text{MIN}\left\{\frac{Y(\text{yellow})}{Yref(\text{yellow})}, \frac{Y(\text{cyan})}{Yref(\text{cyan})}, \frac{Y(\text{magenta})}{Yref(\text{magenta})}\right\},$$

$$Y(\text{white}) = Yref(\text{white}) \times \frac{Y(\text{yellow})}{Yref(\text{yellow})}, \text{ and}$$

$$Y(\text{white}) = Y(\text{yellow})$$

wherein Y(X) is a luminance value of color X, Yref(X) is a luminance value of color X of a reference display device having an RGB pixel structure, and MIN Y(X, Y, Z) is the minimum luminance value among X, Y, and Z.

2. The liquid crystal display of claim 1, further comprising a timing controller for supplying the digital data from the image conversion unit to the data driving circuit and controlling the data driving circuit and the gate driving circuit.

3. The liquid crystal display of claim 1, wherein the image conversion unit comprises:

a frame buffer for temporarily storing input RGB digital data;

an achromatic analysis part for calculating the luminance of white data after analyzing pixel data of the input RGB digital video data and determining the pixel data as white data;

a chromatic histogram part for analyzing the distribution of gray scales of the luminance values of the pure colors input from the chromatic analysis part;

an achromatic histogram part for analyzing the distribution of gray scales of the luminance values of white input from the achromatic analysis part;

a white/pure color correction part for detecting an image showing a brightness contrast by analyzing pure color histogram information from the chromatic histogram analysis part and achromatic histogram information from the achromatic histogram analysis part and converting the white luminance of the white background into a value satisfying any one of the above equations upon detecting the image having brightness contrast; and a data conversion part for correcting the white luminance of RGBW pixels displaying the white background of the image having brightness contrast by using the RGB digital data input from the frame buffer and a correction value from the white/pure color correction part.

4. The liquid crystal display of claim 1, wherein the image conversion unit equalizes the white luminance displaying the white background regardless of a gray scale change when the image having brightness contrast is detected, and increases the white luminance in proportion to a gray scale value when images other than the image having brightness contrast are detected.

5. A liquid crystal display, comprising:

an RGBW panel having a plurality of data lines, a plurality of gate lines crossing the data lines, a plurality of TFTs connected to crossings between the data lines and the gate lines, and an RGBW pixel structure;

an image conversion unit for converting one or more of R subpixel data, G subpixel data, B subpixel data, and W subpixel data displaying a pure color image into a value higher than an input value upon detecting a brightness contrast image including a pure color image with a white background;

a data driving circuit for converting digital data converted by the image conversion unit into positive/negative analog data voltages; and a gate driving circuit for supplying gate pulses to the gate lines, wherein the image conversion unit equalizes the white luminance displaying the white background regardless of a gray scale change when the image having brightness contrast is detected, and increases the white luminance in proportion to a gray scale value when images other than the image having brightness contrast are detected.

6. The liquid crystal display of claim 5, wherein, upon detecting a brightness contrast image including a pure color image corresponding to any one of a yellow, a cyan, and a magenta image with the white background, the image conversion unit converts the white luminance Y(white) of data displaying the white background of the brightness contrast image into a value satisfying any one of the following equations:

$$Y(\text{white}) = Yref(\text{white}) \times \text{MIN}\left\{\frac{Y(\text{yellow})}{Yref(\text{yellow})}, \frac{Y(\text{cyan})}{Yref(\text{cyan})}, \frac{Y(\text{magenta})}{Yref(\text{magenta})}\right\},$$

$$Y(\text{white}) = Yref(\text{white}) \times \frac{Y(\text{yellow})}{Yref(\text{yellow})}, \text{ and}$$

$$Y(\text{white}) = Y(\text{yellow})$$

wherein Y(X) is a luminance value of color X, Yref(X) is a luminance value of color X of a reference display device having an RGB pixel structure, and MIN Y(X, Y, Z) is the minimum luminance value among X, Y, and Z.

7. The liquid crystal display of claim 5, further comprising a timing controller for supplying the digital data from the image conversion unit to the data driving circuit and controlling the data driving circuit and the gate driving circuit.

8. The liquid crystal display of claim 5, wherein the image conversion unit comprises:

a frame buffer for temporarily storing input RGB digital data;

a chromatic analysis part for calculating the luminance of yellow data, cyan data, or magenta data after analyzing pixel data of the input RGB digital video data, and determining the pixel data as the yellow data, the cyan data, or the magenta;

an achromatic analysis part for calculating the luminance of white data after analyzing pixel data of the input RGB digital video data and determining the pixel data as white data;

a chromatic histogram part for analyzing the distribution of gray scales of the luminance values of the pure colors input from the chromatic analysis part;

an achromatic histogram part for analyzing the distribution of gray scales of the luminance values of white input from the achromatic analysis part;

a white/pure color correction part for detecting an image showing a brightness contrast by analyzing pure color histogram information from the chromatic histogram analysis part and achromatic histogram information from the achromatic histogram analysis part and converting one or more of the subpixel data into a value higher than an input value upon detecting the image having brightness contrast; and a data conversion part for correcting the white luminance of RGBW pixels displaying the white background of the image having brightness contrast by using the RGB digital data input from the frame buffer and a correction value from the white/pure color correction part.

* * * * *